United States Patent [19]

Kincaid et al.

[11] 4,380,915

[45] Apr. 26, 1983

[54] LATCH HAVING A REMOVABLE LOCK

[75] Inventors: Herbert Kincaid, Libertyville; Michael L. Wray, Wheeling, both of Ill.

[73] Assignee: The Eastern Company, Naugatuck, Conn.

[21] Appl. No.: 251,155

[22] Filed: Apr. 6, 1981

[51] Int. Cl.[3] ..... E05B 9/04; E05B 9/08; E05B 13/10; E05B 33/00

[52] U.S. Cl. ..... 70/224; 70/215; 70/370; 70/371; 70/DIG. 20; 70/DIG. 27

[58] Field of Search ..... 70/215, 224, 371, 370, 70/451, 367, 368, 369, 216, 217, DIG. 20, DIG. 27, DIG. 31

[56] References Cited

U.S. PATENT DOCUMENTS

| | | | |
|---|---|---|---|
| 1,247,532 | 11/1917 | Heath | 70/215 X |
| 1,420,226 | 6/1922 | Voight | 70/371 X |
| 1,574,321 | 2/1926 | Vincent | 70/215 |
| 1,954,209 | 4/1934 | Jacobi | 70/370 X |
| 2,023,941 | 12/1935 | Voight | 70/224 |
| 2,036,764 | 4/1936 | Lowe | 70/369 |
| 2,046,831 | 7/1936 | Lowe | 70/370 UX |
| 3,316,742 | 5/1967 | Wellekens | 70/371 X |
| 3,438,227 | 4/1969 | Wolniak . | |
| 3,548,618 | 12/1970 | Dauenbaugh | 70/371 X |

FOREIGN PATENT DOCUMENTS

| | | | |
|---|---|---|---|
| 1024839 | 2/1958 | Fed. Rep. of Germany | 70/371 |
| 2910295 | 9/1980 | Fed. Rep. of Germany | 70/215 |
| 2040344 | 8/1980 | United Kingdom | 70/215 |

*Primary Examiner*—Cornelius J. Husar
*Assistant Examiner*—Carl F. Pietruszka
*Attorney, Agent, or Firm*—Wood, Dalton, Phillips, Mason & Rowe

[57] ABSTRACT

A latch, as for a door, having a handle movable to latch and unlatch the door and a removable lock located within the handle. The lock is provided with a stop engaging finger on its end and a retractable bolt on its side. The lock receptacle in the handle has a plurality of bolt engaging surfaces therein which hold the lock in the handle in a locked position wherein the finger engages the stop to prevent movement of the handle, hold the lock in the handle in an unlocked position in which the finger does not engage the stop, and provide a means whereby the bolt may be completely retracted for lock removal.

13 Claims, 13 Drawing Figures

15
23
17
21
18
24
48
16
20
15
17
48
18
16
19
20

(KEY)
26
23
54
16
47

46
23
21
20
27

21
23
27
20
42
44
24
43
22
26
47
25

46
54a
23

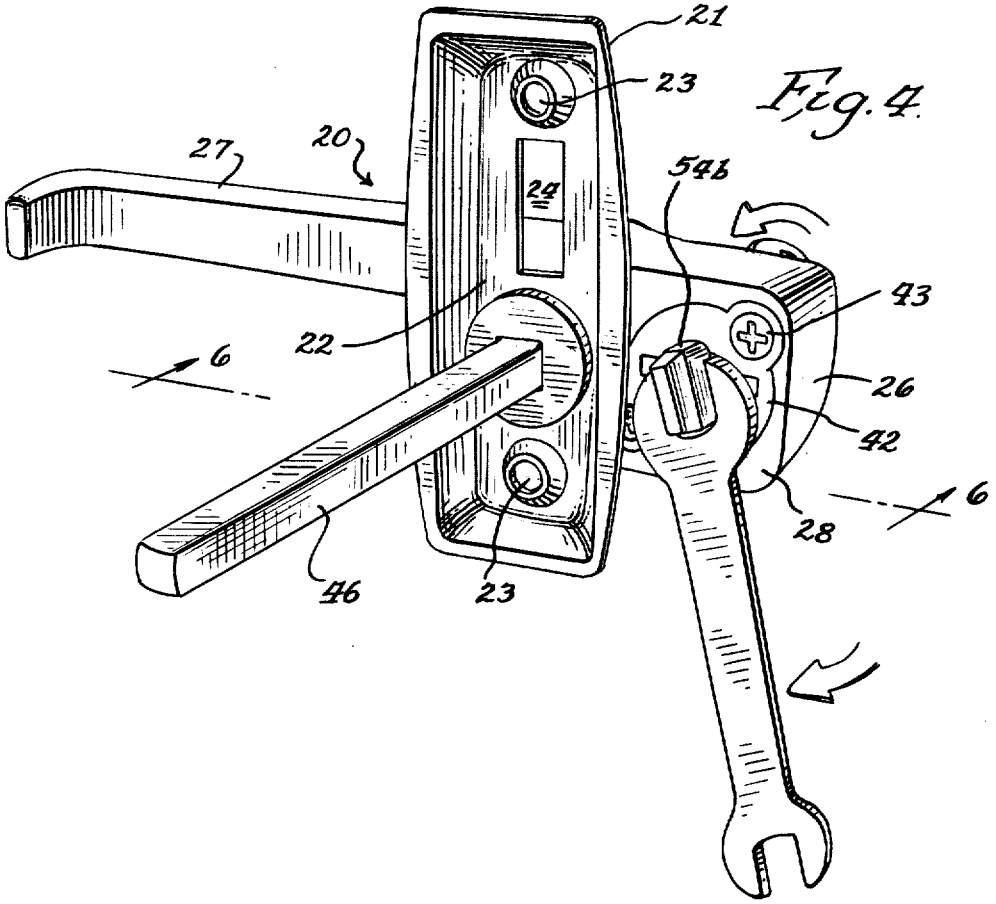
Fig. 4.
Fig. 5.
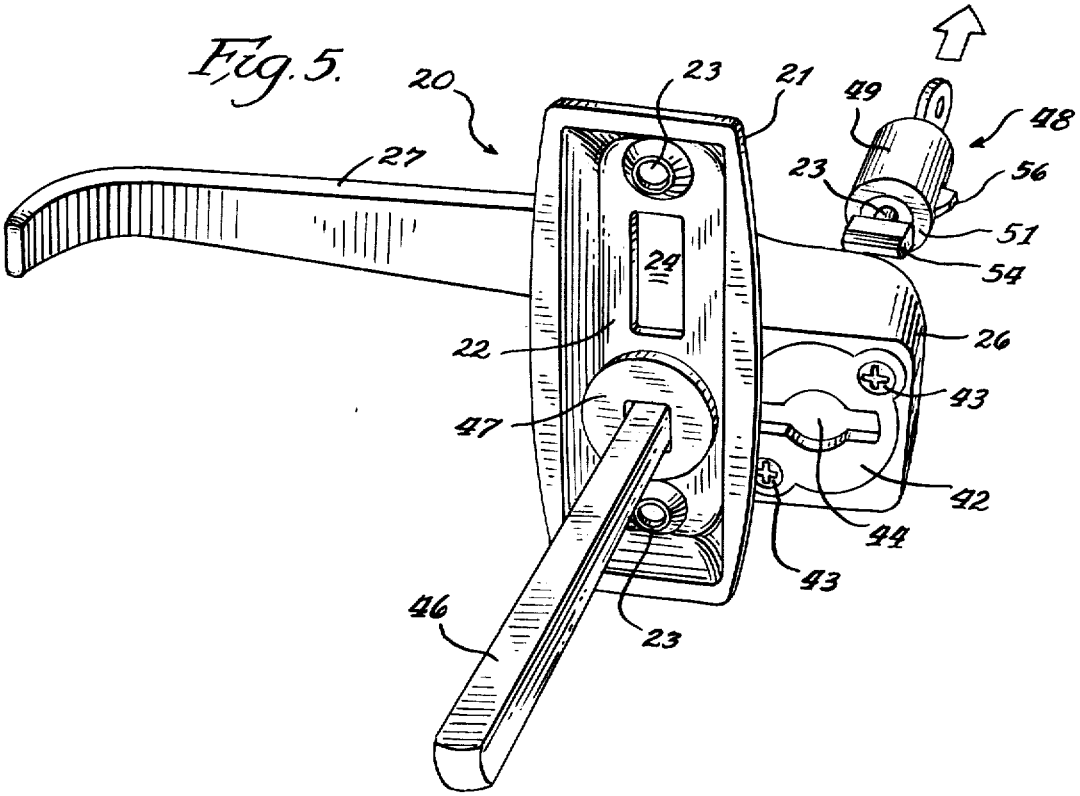

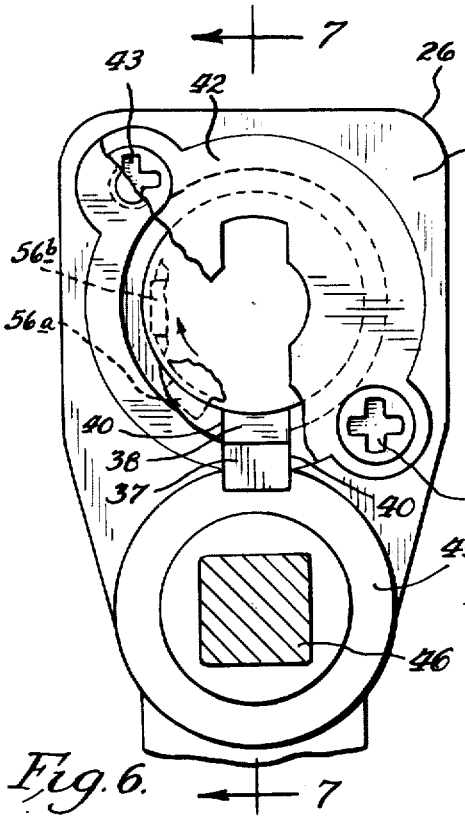
Fig. 6.
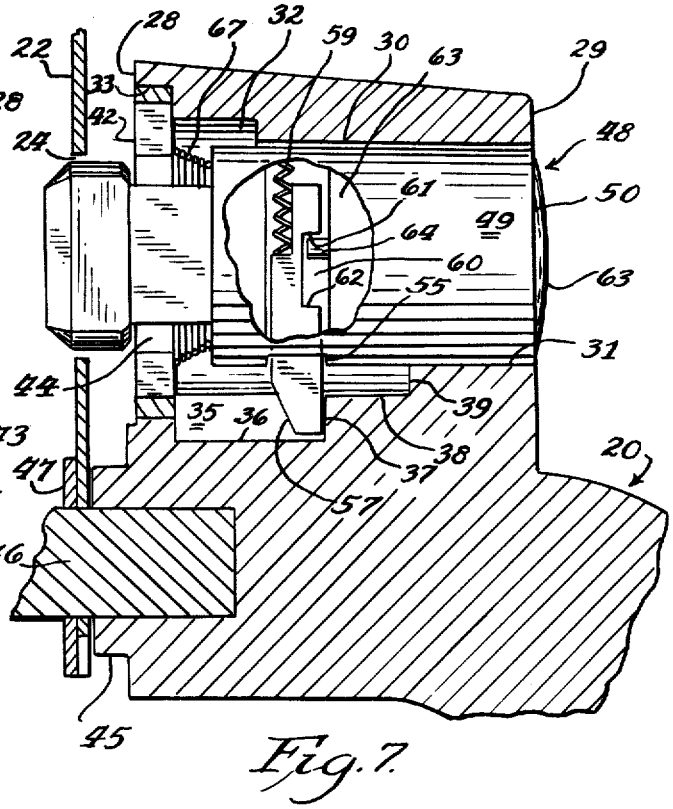
Fig. 7.
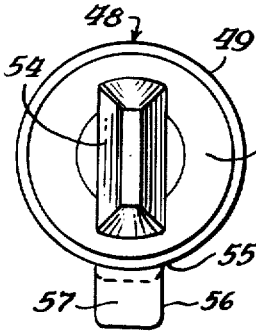
Fig. 9.
Fig. 8.
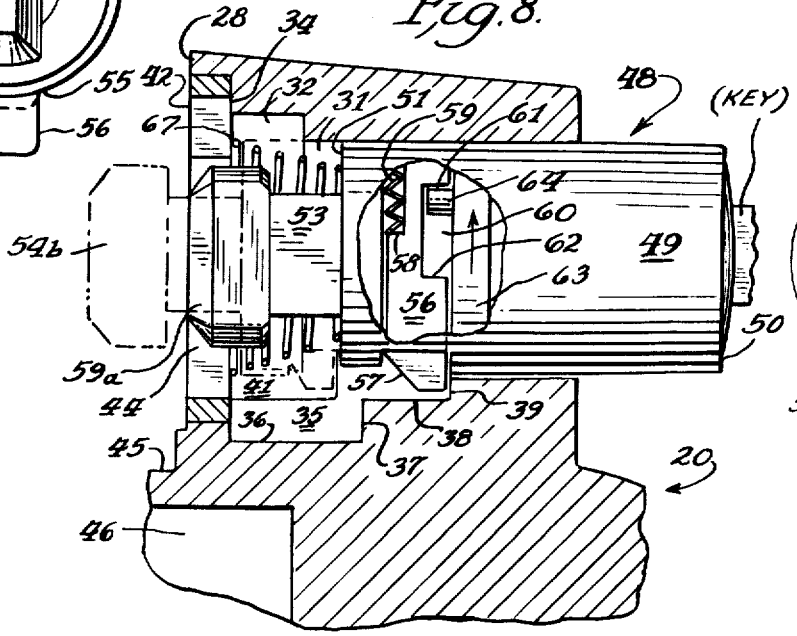
Fig. 10.
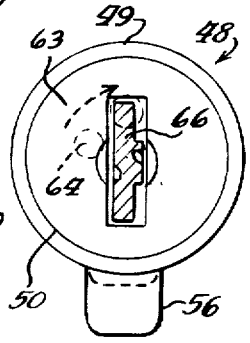

LATCH HAVING A REMOVABLE LOCK

BACKGROUND OF THE INVENTION

1. Field of the Invention

This application relates to a latch and more particularly a door latch of the type having a fixed mounting on a door and a latch operating handle carrying a lock whereby the handle may be locked to the mounting when the door is latched.

2. Description of the Prior Art

Doors, windows and other accesses to areas wherein admittance is to be restricted have long been provided with latches which are capable of being locked. An excellent example can be found on vehicles such as vans or trucks. These vehicles are provided with a door which permits entrance into the vehicle or a restricted portion thereof. The door houses a latch mechanism, operable by movement of a handle located on the general access side of the door, which is capable of latching the door in a closed position. The door is locked closed by closing the door, moving the handle to actuate the latching mechanism to latch the door and finally locking the mechanism in the latched position. The locking of the latch mechanism is accomplished by providing a key-operated lock within the door or the handle capable of, when locked, holding the latch in a latched position or if the lock is within the handle, holding the handle fixed to the door. A person desirous to open the door, unlocks the lock, which in turn either frees the door latch or the handle, and operates the handle to unlatch the door.

A drawback heretofore observed in the use of these latch-lock systems is that of changing the lock. As sometimes occurs, the key to these locks may fall into the hands of those who have no authority to enter the vehicle or its restrictive portion. A result of this is that a lock change is necessitated. The change of these locks is often complicated, requiring the services of an expert locksmith, expensive, and always time consuming. The usual method is to either replace the entire lock or handle assembly housing the lock or to temporarily remove the handle for access to the lock assembly for its removal and replacement.

It is a primary object of this application to set forth a handle-lock assembly wherein the lock replacement problem, noted above, is overcome.

SUMMARY OF THE INVENTION

Accordingly, a latch handle is provided wherein a key operated lock can be easily removed so that a lock change may readily be accomplished.

Toward this end a handle is provided which is movable to operate a latch mechanism from a latched to an unlatched position. Within the handle there is located a key operated removable lock having on its end a stop engaging finger and on its side a retractable key operated bolt. The lock receptacle within the handle to accommodate the lock is provided with a first bolt engaging surface to hold the lock, when locked, within the handle in a first position such that the finger engages the stop and holds the handle in a latched position. Unlocking of the lock, to free the handle for operation of the latch, partially retracts the bolt to disengage said bolt from the first bolt engaging surface. The lock, being biased by a spring within the lock receptacle, moves such that the finger is withdrawn from the stop until the bolt contacts a second bolt engaging surface.

The second bolt engaging surface serves to hold the lock within the handle in an unlocked, second position. Removal of the lock is accomplished by using a cam surface circumferentially located within the lock receptacle. Positioning the lock within the lock receptacle in a third position wherein the finger extends from the receptacle and rotation of the lock such that the bolt follows the cam surface, fully retracts the bolt so that the lock may be removed from the handle, and does so automatically due to the bias of the aforementioned spring.

It is therefore an object of this application to set forth a latch operating handle wherein a lock may be quickly and easily removed and a substitute lock may be just as easily and quickly inserted into the handle.

Further objects and advantages will become apparent from a study of the following portions of the specification, the claims and the attached drawings.

BRIEF DESCRIPTION OF THE DRAWINGS

FIG. 4 is a perspective view of the latch handle wherein the removable lock is being rotated for removal of the lock;

FIG. 5 is a perspective view of the handle with the lock removed;

FIG. 6 is a fragmentary view of the latch handle taken along line 6—6 of FIG. 4, with some of the elements broken away to illustrate release of the lock for its removal;

FIG. 7 shows a sectional view along line 7—7 of FIG. 6 of the latch handle with the removable lock in a locked position. A portion of the lock barrel has been removed exposing the interior of the lock;

FIG. 8 is a section similar to FIG. 7 with the removable lock shown in an unlocked position and, by broken lines, in position for removal;

FIGS. 9–10 show, respectively, the lock as viewed on its finger end and keyway end;

DESCRIPTION

Figure 1:
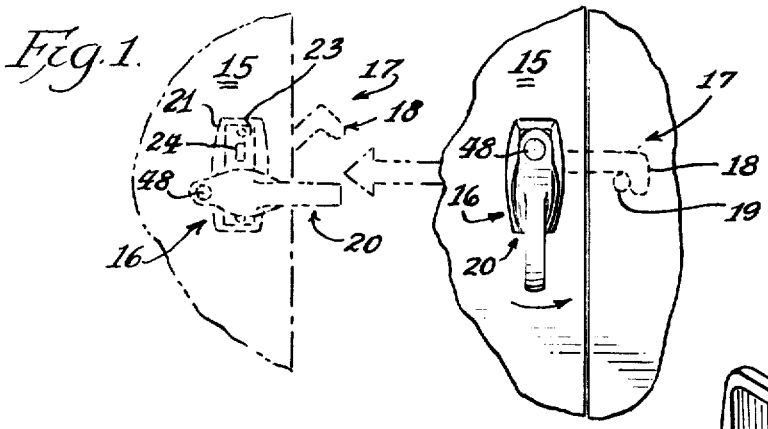
FIG. 1 shows a typical handle operated door latch with the door latched and unlatched (broken lines)

Turning now to the drawings, FIG. 1 shows a door 15 for a vehicle such as a van or a truck in the closed (solid line) and opened (dashed line) positions. The door 15 has mounted on its exterior a latch handle assembly 16 which communicates with a door latch mechanism 17 whereby said door 15 may be latched closed as shown on the right hand side of FIG. 1. For purposes of illustration the door latch mechanism 17 is shown as comprising a hook-like latching member 18 which, to latch the door is a closed position, hooks a latch pin 19.

It is to be understood that the foregoing description of the door latch mechanism 17 is not exclusive, for differing latch mechanisms may be used. To operate the latching member 18 so as to cause it to disengage the latch pin 19 thereby freeing the door 15 for opening, the latch handle assembly 16 is comprised of a rotatable handle 20 the rotation of which, as shown in FIG. 1, lifts the latching member 18 from engagement with the latch pin 19 freeing the door 15 for opening thereof. The latch handle assembly 16 also contains an escutcheon 21 which not only serves to mount the handle 20 to the door 15 but also provides a means whereby the handle 20 may be locked in a position wherein the latching member 18 engages the latch pin 19.

Figure 2:
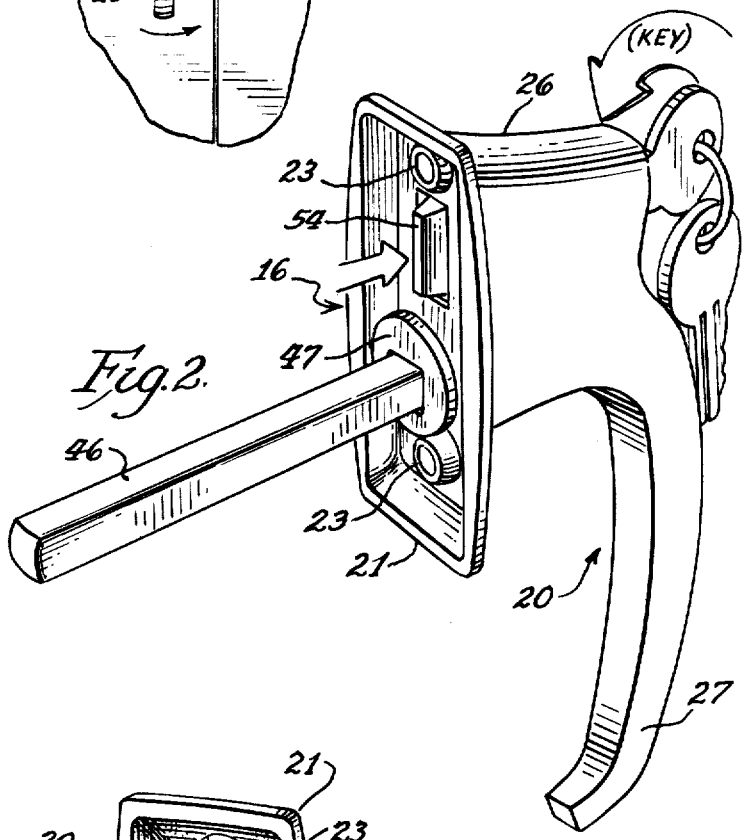
FIG. 2 shows a perspective view of the latch handle with the removable lock in the locked position and the handle in a latched position.

The escutcheon 21 is generally rectangular and has an arcuate main body portion 22 which is convex to the surface of the door 15 when the escutcheon 21 is mounted thereon. To affix the escutcheon 21 to the door 15 a pair of counter-sunk bores 23 are formed through the main body portion 22 of the escutcheon 21, and receive mounting screws (not shown) which pass therethrough and into the door 15 firmly affixing the escutcheon 21 thereto. In the main body portion 22 of the escutcheon 21, as shown in FIG. 2, there is formed a rectangular opening 24 which, as subsequently described, forms a stop or mating surface for cooperation with the handle 20 to hold the handle 20 in a position wherein the door latch mechanism 17 has latched the door 15 closed. A second opening is made through the main body portion 22 of the escutcheon 21 and forms a shaft passageway 25 through which the handle 20 communicates with the door latch mechanism 17.

The handle 20 which operates the door latch mechanism 17 is shown in FIG. 2 as being comprised of a lock housing 26 having a gripping arm 27 extending therefrom. Turning to FIGS. 6 and 7 it can be seen that the lock housing 26 has a front face 28 opposed by a rear face 29 both of which are flat and, when the handle 20 is mounted on the door 15, are parallel to the door 15. For purposes of illustration the lock housing 26 is shown as being pyramidal in form having the front face 28 for a base, however it should be noted that other configurations of the lock housing 26 could equally be used.

Within lock housing 26 is a lock receptacle 30. The lock receptacle 30 is comprised, in part, of three coaxial bores the axes of which are orthogonal to the front and rear faces 28 and 29. The first of these bores is the lock receiving bore 31 which extends medially through the rear face 29 to a depth representing approximately two-thirds the span between the front and rear faces 28 and 29. A bias spring receiving bore 32, the second coaxial bore, extends from the lock receiving bore 31, has a terminus near the front face 28 and is of a diameter somewhat larger than that of the lock receiving bore 31. The third and last of the coaxial bores is the face plate receiving bore 33 which extends from the bias spring receiving bore 32 through the front face 28. The face plate receiving bore 33 has a diameter larger than that of the bias spring receiving bore 32 thereby forming at their interface a circumferential lip 34.

Contributing further to the structure of the lock receptacle 30 is a stepped trough 35 which is located in the walls of and communicates with the lock receiving bore 31 and the bias spring receiving bore 32. The lower tread 36 of the stepped trough 35 extends in a planar fashion from the lip 34 towards the rear face 29 terminating at a first bolt engaging surface shown as the first riser 37 which, as can be seen in FIGS. 7 and 8, is located medially within the lock receptacle 30. Relative to the axis extending through the face plate receiving bore 33 the lower tread 36 is slightly more distant than the radial length of the face plate receiving bore 33. The aforementioned first riser 37 extends perpendicular from the lower tread 36 towards the axis of the lock receiving bore 31 for approximately one-half the distance between the lower tread 36 and the wall of the lock receiving bore 31. Extending from the first riser 37 towards the rear face 29 is the upper tread 38. The upper tread 38 is parallel to the lower tread 36 and terminates at the second riser 39. The second bolt engaging surface depicted as the second riser 39 extends perpendicularly through the median wall of the lock receiving bore 31. The sidewalls 40 of the stepped trough 35 are, as shown in FIG. 6, parallel to each other and extend perpendicularly from the lower tread 36 and the upper tread 38 terminating at the walls of the bias spring receiving bore 32 and the lock receiving bore 31.

Completing the structure of the lock receptacle 30 is a cam surface 31 which extends from a sidewall 40 of the stepped trough 35, in a spiral fashion, inward towards the axis of the lock receiving bore 31 and the bias spring receiving bore 32 terminating at their respective walls. As can be seen in FIG. 8 the cam surface 41 extends through the sidewall 40 along a line co-planar with the upper tread 38 and has a length which is slightly less than that of the lower tread 36. Furthermore due to the differing diameters of the lock receiving bore 31 and the bias spring receiving bore 32 the cam surface 41 exits into the aforementioned bores at different points along their respective cylindrical walls.

A face plate 42 is affixed into the face plate receiving bore 33 by means such as mounting screws 43. As can be seen in FIGS. 6 through 8 the face plate 42 is disk-shaped having a diameter and thickness equal to the diameter and length of the face plate receiving bore 33. When affixed within the face plate receiving bore 33 the face plate 42 rests against the lip 34 with one side while the opposing side is flush with the front face 28 so as not to hinder the operation of the handle 20. Furthermore, as can be seen in FIG. 5, a rectangular opening with an axial bore forming a finger passageway 44 extends coaxially through the face plate 42 having its rectangular portions comparable to the rectangular opening 24 of the escutcheon 21 in both length and width.

Formed on the front face 28 in that area of the handle which joins the lock housing 26 and the gripping arm 27 there extends a cylindrical boss 45 about the axis of which the handle 20 will pivot for its rotation. Extending from the handle 20 coaxially through the boss 45 is a shaft 46 which provides the means to translate the rotation of the handle 20 into the lifting of the latching member 18 of the door latch mechanism 17. For illustrative purposes the shaft 46 is shown as rectangular.

Figure 3:
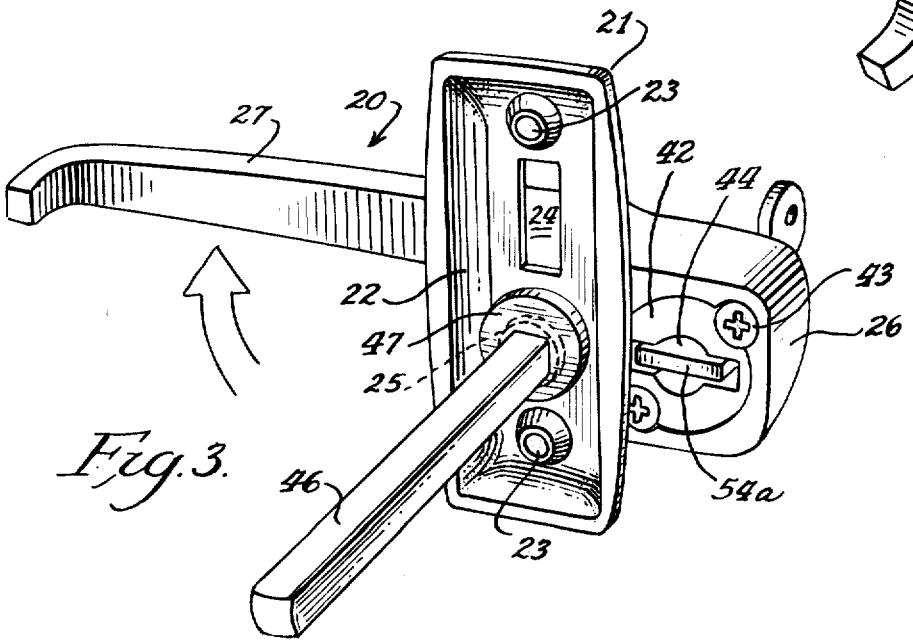
FIG. 3 is a perspective view of the latch handle with the removable lock in the unlocked position and the handle rotated to an unlatched position.

From the aforementioned description the mounting of the handle 20 to the door 15 and its operation can be set forth. The shaft 46 is extended through the shaft passageway 25 of the escutcheon 21 until the boss 45 contacts the main body portion 22 of the escutcheon 21. A retaining washer 47 is affixed to the shaft so as to sandwich the main body portion 22 between it and the boss 45. The escutcheon 21 is thereafter affixed to the door 15 such that the shaft 46 is connected to and communicates with the door latch mechanism 17. To operate the door latch mechanism 17 an operator grasps the gripping arm 27 and rotates the handle 20 90° about the axis of the boss 45, which motion is in turn translated to the door latch mechanism 17 to lift a latching member 18 from the latch pin 19. As can be seen in FIG. 3 the aforementioned rotation of the handle 20 results in the lock housing 26 and more particularly the finger passageway 41 being positioned to one side of the escutcheon 21.

Within the lock housing 26 of the handle 20 there is located a removable lock 48. As can be seen in FIGS. 7 through 10 the removable lock 48 has a hollow cylindrical barrel 49 whose outer diameter is slightly less than the lock receiving bore 31 thereby allowing the removable lock 48 to be slidably positioned within the lock receptacle 30. The barrel 49 has an open end 50 which is opposed by a closed end 51. Upon the closed end 51 there is formed finger 52. The finger 52 has a rectangular post 53 which extends from the closed end 51 having, affixed upon its end, a rectangular shaped member 54 whose end opposing said post 53 is chamferred.

Through the wall of the barrel 49 near the closed end 51 is a rectangular bolt passageway 55. Extending through the bolt passageway 55 is a radially extendable and retractable bolt 56. The bolt 56 is generally rectangular having a length such that it may be completely withdrawn into the barrel 49 and a thickness slightly less than that of the stepped trough 35 so that it may be inserted therein. As can be seen in FIG. 7 the bolt 56 has the end which extends from the barrel 49 beveled to form an angularly leading edge 57 directed approximately at the finger post 53. The end of the bolt 56 opposing the leading edge 57 has a bolt spring receiving notch 58 therein. The bolt spring receiving notch 58 in cooperation with the side of the closed end 51, which opposes the finger 52, and the inside wall of the barrel 49 forms a housing for a bolt spring 59 which biases the bolt 56 toward an extended position. The bolt 56 also has medially located therein a rectangular lock pin receiving notch 60. The lock pin receiving notch 60 faces the open end 50 of the barrel 49 and has as its upper and lower extremities respectively an upper shoulder 61 and a lower shoulder 62.

Received into the open end 50 of the barrel 49 for rotation therewith is a key operated tumbler mechanism 63. The tumbler mechanism 63 has on one end an eccentrically mounted lock pin 64 which is received into the lock pin receiving notch 60. The end of the tumbler mechanism 63 opposing the lock pin 64 is somewhat spherical having its periphery co-planar with the open end 50 of the barrel 49. Extending through the middle of the tumbler mechanism 63 is a rectangular keyway 66 through which a key may be inserted into and communicate with the tumbler mechanism 63.

Viewing FIG. 7, the removable lock 48 is located within the lock receptacle 30 in a locked position. The tumbler mechanism 63 is locked and, due to the bias of the bolt spring 59, the upper shoulder 61 of the bolt 56 is held in engagement with the lock pin 64 and the bolt 56 is fully extended. The full extension of the bolt 56 results in a positioning of the bolt 56 into the stepped trough 35 so as to be very near the lower tread 36. A lock spring 67 is located within the bias spring receiving bore 32 and is supported between the closed end 51 of the removable lock 48 and the face plate 42. The lock spring 67 exerts a bias upon the removable lock 48 forcing it away from the face plate 42 such that the bolt 56 engages and rests against the first riser 37. In this position the finger 52 extends through the finger passageway 44 in the face plate 42 so as to locate the locking member 54 within the rectangular opening 24 of the escutcheon 21. With the removable lock 48 and the finger 52 so positioned the handle 20 remains fixed to the escutcheon 21 since rotation of the handle 20 can not take place while the locking member 54 of the finger 52 extends into the rectangular opening 24.

To unlock the handle 20 for subsequent rotation of the handle 20 the proper key is inserted into the keyway 66 thereby aligning the proper tumblers in the tumbler mechanism 63. Rotation of the key, as shown in FIG. 2, rotates the tumbler mechanism 63 clockwise, as viewed from the rear face 29, within the barrel 49 causing the lock pin 64 to move in an arcuate fashion. The movement of the lock pin 64 is followed by the upper shoulder 61 which results in the retraction of the bolt 56 against the bias of the bolt spring 59. As the lock pin 64 reaches its uppermost position the concomitant partial retraction of the bolt 56 lifts said bolt 56 past the first riser 37 to a position slightly above the upper thread 38. When the bolt 56 clears the first riser 37 the lock spring 67 forces the removable lock 48 to a second position wherein the bolt 56 is held in engagement with the second riser 39. As can be seen in FIG. 8 the positioning of the removable lock 48 to the unlocked position results in the withdrawing of the lock member 54 of the finger 52 from the rectangular opening 24 of the escutcheon 21 to a position shown as **54*a*. The movement of the removable lock 48 from the first riser 37 to the second riser 37 also necessarily results in the protrusion of the barrel 49 from the rear face 29. With the removable lock 48 in this position the handle 20 can be rotated as seen in FIG. 3 to operate the door latch mechanism 17 and unlatch the door 15**.

With the handle 20 in the unlatched position the removal of the removable lock 48 can also take place. As shown by the broken lines in FIG. 8, the removable lock 48 is forced back into the lock receptacle 30 against the bias of the lock spring 67 to a third position such that the lock member 54 extends through the face plate 52 to a position shown by **54*b*. By comparison this third position of the removable lock 48 extends the lock member 54 somewhat further from the finger passageway 44 than the location of the lock member 54 assumed when the removable lock 48 is in the first, locked position. This locates the partially retracted bolt 56 in alignment for subsequent engagement with the cam surface 41. Suitable means such as a wrench as shown in FIG. 4 are applied to the lock member 54 to rotate the lock member 54, opposite to the direction of rotation of the tumbler mechanism 63, and the connected removable lock 48. As the lock member 54 is rotated the bolt 56 follows the cam surface 41 to become completely retracted within the barrel 49. Moving through the intermediate positions 56*a* and 56*b* in FIG. 6 the bolt 56 moves against the bias of the bolt spring 59 such that it is completely withdrawn into the barrel 49. It should be noted that during the rotation of the removable lock 48 the key and the tumbler mechanism 63 are held unlocked such that the lock pin 64 is at its uppermost position and lock pin receiving notch 60 is of a size such that the lower shoulder 62 does not at any time contact the lock pin 64 thereby preventing the retraction of the bolt 56. It should also be noted that the finger passageway 44 has a configuration such that the post 53** may freely rotate therein.

Upon the 180° rotation of the lock member 54 the lock member 54 is free to pass through the finger passageway 44. Due to the bias of the lock spring 64 the removable lock 48 is forced from the lock receptacle 30 out of the rear face 29 as the lock member 54 passes through the finger passageway 44. With this, the removable lock 48 is completely removed from the handle 20 as shown in FIG. 5.

To insert a replacement lock the proper key is inserted in the keyway 66 and the tumbler mechanism 63 is rotated to an unlocked position wherein the lock pin 64 is at its uppermost position and the bolt 56 is partially retracted. The removable lock 48 is inserted through the rear face 29 and into the lock receptacle 30 with the finger 52 leading the way. Upon contact between the bolt 56 and the rear face 29 the beveled leading edge 57 causes the bolt 56 to completely retract into the barrel 49. As the retracted bolt 56 clears the second riser 39 the bolt spring 59 forces the bolt 56 from the barrel 49 near the upper tread 38. It should be noted to accomplish the aforementioned the lock member 54 must be orientated so that it may pass through the finger passageway 44.

To lock the handle 20 and thereby the door latch mechanism 17 to the escutcheon 21 the door 15 is closed and the handle 20 is rotated such that the latching member 18 engages the latch pin 19. The key within the tumbler mechanism 63 is rotated to the locked position and removed whereupon the lock pin 64 has moved to its lowermost, locked position. The lock pin receiving notch 60 is of such a size that the lock pin 64 lies contiguous with the lower shoulder 62 of the bolt 56. The operator then pushes the extended portion of the barrel 49 into the lock receptacle 30 causing the finger 52 to extend through the finger passageway 44 and the lock member 54 to be inserted into the rectangular opening 24. As the bolt 56 held in contact with the upper tread 38 by the bolt spring 39, moves forward from the upper tread 38 it is extended outward by the bolt spring 59 for engagement with the first riser 37 which is maintained due to the bias of the lock spring 67. In this position the door 15 is latched closed and is locked in that position due to the enability to rotate the handle 20.

While we have described a preferred embodiment of a latch having a handle with a removable lock certain latch mechanisms are such that they are operated by and restrict the handle 20 to a pivoting motion substantially less than 90°. The end result is that the handle 20 with its removable lock 48 can not be pivoted a sufficient amount to enable the finger 52 to be extended to one side of the escutcheon 21 for its rotation which is required to remove the removable lock 48.

Figure 11:
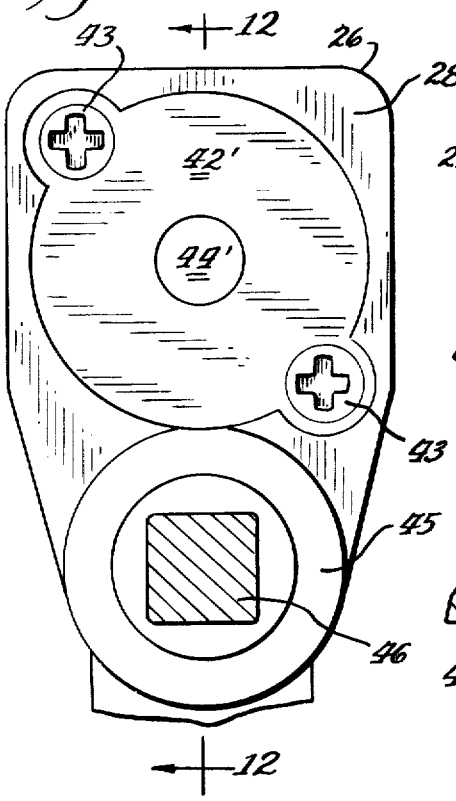
FIG. 11 is an elevation of an additional embodiment of the latch taken along a line corresponding to that of line 6—6 of FIG. 4, with some of the elements broken away to illustrate release of the lock for its removal.
Figure 12:
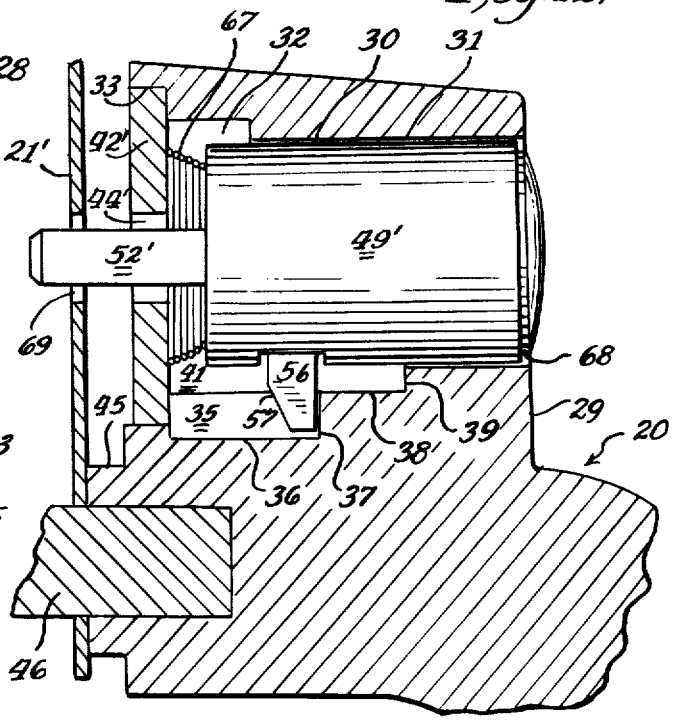
FIG. 12 is a section view along line 12—12 of FIG. 11 of the latch of FIG. 11 with the removable lock in a locked position.
Figure 13:
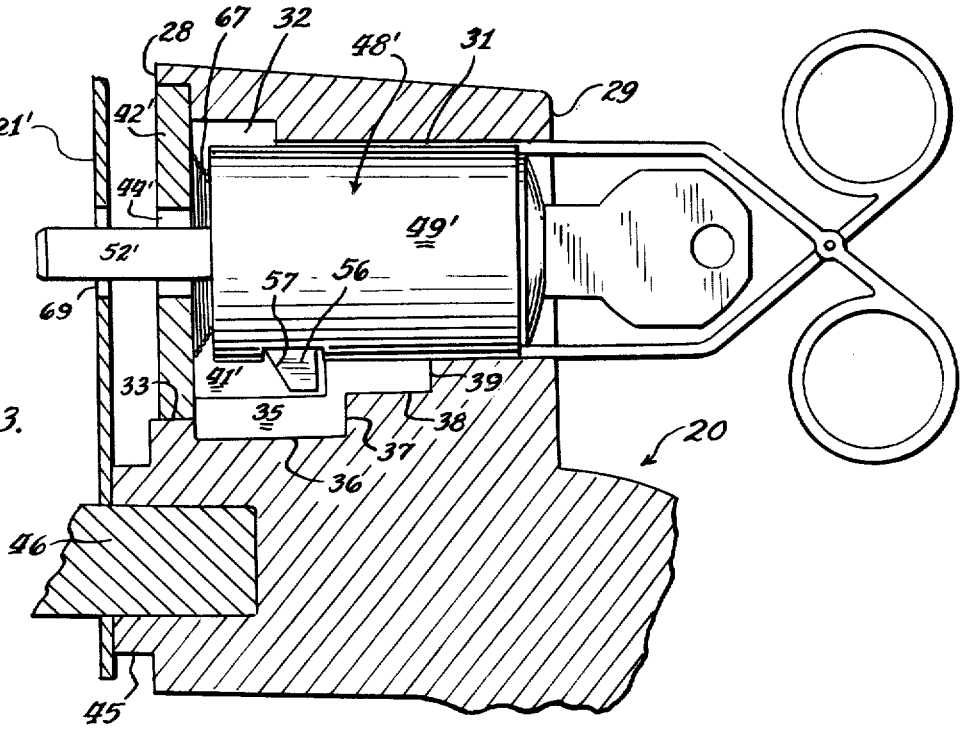
FIG. 13 is a view similar to FIG. 12 with the lock in a position for removal.

To accommodate such latching mechanisms certain modifications, shown in FIGS. 11 through 13, are required to the latch handle assembly 16 described in detail above. Elements common to both the above described latch handle assembly 16 and the modified version hereinafter set forth have the same reference numerals. Modified elements have a "prime" designation while additional elements have new reference numerals. Into the lock receptacle 30 of the handle 20 which was described above there is inserted a modified removable lock 48'. The modified removable lock 48' is identical the previously described removable lock 48 except for two structural modifications. The first modification is the replacement of the finger 52 with a solid cylindrical finger 52'. The finger 52' is of the same overall length as the previously described finger 52. The second modification takes the form of a pair of recesses 68 formed on the end of the barrel 49' of the removable lock 48' which opposes the finger 52'. The recesses 68 diametrically oppose each other and provide a gripping surface accessible from the rear face 29 of the handle 20.

To further accommodate this modified embodiment of a latch having a removable lock a face plate 42' has a circular finger passageway 44' of a diameter so as to allow the finger 52' to axially pass therethrough. It should be noted that the outer dimensions of the face plate 42' are identical to that of the previously described face plate 42 thereby facilitating their interchangeable affixing to the handle 20 by the mounting screws 43.

The final modification required is that to the escutcheon 21. The escutcheon 21' is identical to the previously described escutcheon 21 except that the rectangular opening 24 is replaced by a circular opening 69. The circular opening 69 is of a size to allow the finger 52' to pass therethrough.

With the modifications set forth above the locking, unlocking and the removal of the modified removable lock 48' and the door latch mechanism 17 can be set forth. To lock the handle 20 to the escutcheon 21', which in turn holds the door latch mechanism 17 in a latched position, the handle 20 is rotated such that the finger passageway 44' is coaxially aligned with the circular opening 69 of the escutcheon 21'. The removable lock 48' is moved from its unlocked position, wherein its bolt 56 engages the second riser 39 into the lock receptacle 30, such that the bolt 56 extends to engage the first riser 37 and the finger 52' protrudes through the finger passageway 44' and into the circular opening 69. In this position the handle 20 can not rotate to operate the door latch mechanism 17.

To remove the modified removable lock 48' from the lock receptacle 30 the proper key is once again inserted into the keyway 66 and is rotated which in turn retracts the bolt 56 from the first riser 37 for engagement with the second riser 39. With the bolt 56 in this position the lock spring 67 forces the removable lock 48' to a position wherein the finger 52' is withdrawn from the circular opening 69 and the barrel 49' protrudes through the rear face 29. While maintaining the handle 20 in the latched position the removable lock 48' is forced back into the lock receptacle 30 by a scissor-like tool which engages the recesses 68 as shown in FIG. 13. This in turn reinserts the finger 52' through the circular opening 69 of the escutcheon 21'. When the bolt 56 is properly positioned within the lock receptacle 30 the tool is rotated such that the removable lock 48' likewise rotates causing the bolt 56 to follow the cam surface 41 for its retraction within the barrel 49'. It should be noted that during this rotation the finger 52' is rotating within its circular opening 69. Once the bolt 56 is completely retracted the lock spring 67 forces the removable lock 48' from the lock receptacle 30. Once again it should be noted that the removal of the removable lock 48' takes place with the handle in the latched position.

While we have shown and described certain embodiments of a latch having a removable lock, it is to be understood that it is capable of many modifications. Changes, therefore, in the construction and arrangement may be made without departing from the spirit and the scope of the device set forth above and as described in the attached claims.

We claim:

1. A latch having a removable lock comprising:

a handle, movable to latch and unlatch the latch, having a bore therethrough;

a lock located within said bore, said entire lock being selectively axially and rotationally movable therein, said lock having fixed on its end a finger extensible from said bore for engagement with a stop to maintain the handle in a latched position, and a key operated retractable bolt on its side;

means engageable by said bolt to hold the lock within said bore in a locked, finger extended position and an unlocked, finger retracted position; and means responsive to rotation of the lock to retract said bolt for lock removal.

2. A latch having a removable lock as described in claim 1 wherein said engageable means is a pair of curbs disposed within said bore.

3. A latch having a removable lock as described in claim 1 wherein said retraction means is a cam surface peripherally located within said bore, engageable by said bolt when said lock is located in a finger extended position and said bolt is in a partially retracted, unlocked position, whereby rotation of said finger rotates the removable lock causing the bolt to follow said cam surface, retracting the bolt.

4. A latch having a removable lock as described in claim 1 further comprising a biasing means to bias said removable lock from a locked to an unlocked position and, when said bolt is retracted, from said bore.

5. A latch having a removable lock as described in claim 1 wherein said lock has a pair of diametrically opposed recesses opposing said finger, said recesses being engageable by a tool to impart rotation to said lock.

6. A lock with a removable lock mechanism, comprising:

a housing with a cylindrical bore;

a lock mechanism disposed within said bore, said entire lock mechanism being selectively axially and rotationally movable therein, the mechanism having a stop engaging finger fixed on its end and a laterally extending bolt which engages a shoulder in the bore to retain the mechanism therein, said bolt being partially retracted by actuation of the lock mechanism for limited axial movement of the mechanism in the housing bore; and a peripheral cam surface in said cylindrical bore for engagement with said bolt upon rotation of said mechanism in the bore, to affect complete retraction of the bolt for removal of the mechanism from the housing.

7. A latch for a door, having a removable lock comprising:

a handle, rotatable to latch and unlatch the door, having a bore therethrough;

a lock removably located within said bore, said entire lock being selectively axially and rotationally movable within said bore, said lock having a finger fixed on its end the distal end of which finger selectively extends from said bore and engages a mating surface which maintains the handle in a latched position, and having a key operated retractable bolt on its side;

a first surface, within said bore, engageable by said bolt when extended in a locked position, to hold said lock in said bore such that the finger engages the mating surface;

a second surface, within said bore, engageable by said bolt when partially retracted in an unlocked position, to hold said lock within said bore such that said finger is disengaged from said mating surface; and a third surface, within said bore, engageable by said bolt when in a partially retracted unlocked position, to completely retract said bolt for lock removal in response to rotation of said lock.

8. A latch for a door as described in claim 7 wherein said first and second surfaces are a pair of axially spaced stepped curbs.

9. A latch for a door as described in claim 7 wherein said third surface is a cam surface peripherally disposed within said bore such that said lock must be located within said bore in a finger extended position in order for said bolt to engage said surface, whereby rotation of said lock is imparted by rotation of said extended finger.

10. A latch for a door as described in claim 7 wherein said third surface is a cam surface peripherally disposed within said bore and said lock has on its end opposing said finger a pair of tool engageable recesses whereby rotation of said lock is imparted by rotation of said tool.

11. A latch for a door as described in claim 7 wherein said lock contains a spring to bias said bolt towards an extended position.

12. An improved lock for a latch of the type operable by rotation of a handle, the improvement comprising:

a lock receptacle on said handle having a bore therethrough;

a removable lock disposed within said bore, said entire lock being selectively axially and rotationally movable within said bore, said lock having a stop engaging finger fixed on its end and a retractable bolt on its side; and a plurality of bolt engaging surfaces within said bore to hold the lock, while locked, within said bore with said finger engaging the stop, to hold the lock within said bore, while unlocked, with said finger disengaged from said stop, and to retract said bolt upon rotation of said lock within said bore for removal of said lock from said bore.

13. An improved lock as described in claim 12 wherein the plurality of bolt engaging surfaces are comprised of:

a pair of axially spaced stepped curbs; and a cam surface on the periphery of said bore engageable by said bolt when said lock is unlocked, whereby rotation of said lock causes said bolt to follow the cam surface for retraction of said bolt.

* * * * *